US005335903A

United States Patent [19]

Martin et al.

[11] Patent Number: 5,335,903

[45] Date of Patent: Aug. 9, 1994

[54] HIGH CAPACITY DUAL TRAY VARIABLE SHEET SIZE SHEET FEEDER

[75] Inventors: Michael J. Martin, Hamlin; George J. Roller, Penfield; Richard Van Dongen, Newark, all of N.Y.

[73] Assignee: Xerox Corporation, Stamford, Conn.

[21] Appl. No.: 160,454

[22] Filed: Dec. 1, 1993

Related U.S. Application Data

[63] Continuation of Ser. No. 982,529, Nov. 27, 1992, abandoned.

[51] Int. Cl.[5] ..... B65H 1/26

[52] U.S. Cl. ..... 271/157; 271/164; 271/171

[58] Field of Search ..... 271/157, 158, 159, 171, 271/162, 164, 147

[56] References Cited

U.S. PATENT DOCUMENTS

| | | | |
|---|---|---|---|
| 4,008,957 | 2/1977 | Summers | 355/14 |
| 4,556,210 | 12/1985 | George | 271/157 |
| 4,640,602 | 2/1987 | Redding et al. | 355/3 SH |
| 5,076,562 | 12/1991 | Sai et al. | 271/159 X |
| 5,085,419 | 2/1992 | Bell | 271/9 |
| 5,085,421 | 2/1992 | Sellers | 271/157 X |
| 5,096,181 | 3/1982 | Menon et al. | 271/157 |
| 5,102,112 | 4/1992 | Takahashi | 271/157 X |
| 5,150,893 | 9/1992 | Uno et al. | 271/157 |

OTHER PUBLICATIONS

*Xerox Disclosure Journal*, vol. 9, No. 2, Mar./Apr., 1984, "Load While Run Copy Handling Module", by Jack R. Oagley.

*Primary Examiner*—Robert P. Olszewski
*Assistant Examiner*—Boris Milef

[57] ABSTRACT

A variable sheet sized sheet feeder adapted to be reloaded while running in a dual tray mode. A dual tray sheet feeder having a sheet transport to reload a stack of sheets from a holding station to an active feed station is provided. The dual tray design allows the holding station to be reloaded while the active tray is feeding thereby providing load while run capability. The feed tray is further provided with tray extensions to allow the loading and feeding of oversized sheets within the same confines. Multiple sensors and movable stack guides are provided to allow the transfer of the sheet stack from one tray to another and to report the status of each tray to the operator through a user interface.

12 Claims, 9 Drawing Sheets

HIGH CAPACITY DUAL TRAY VARIABLE SHEET SIZE SHEET FEEDER

This is a continuation, of application Ser. No. 07/982,529, filed Nov. 27, 1992 now abandoned.

This invention relates generally to a high capacity sheet feeder, and more particularly concerns a dual tray variable sheet size sheet feeder that offers load while run feature for use with electrophotographic printing machines.

In a typical electrophotographic printing process, a photoconductive member is charged to a substantially uniform potential so as to sensitize the surface thereof. The charged portion of the photoconductive member is exposed to a light image of an original document being reproduced. Exposure of the charged photoconductive member selectively dissipates the charges thereon in the irradiated areas. This records an electrostatic latent image on the photoconductive member corresponding to the informational areas contained within the original document. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules to the latent image forming a toner powder image on the photoconductive member. The toner powder image is then transferred from the photoconductive member to a copy sheet. The toner particles are heated to permanently affix the powder image to the copy sheet.

In a commercial printing machine of the foregoing type, particularly for the faster and more sophisticated electrophotographic printing machines now available, it is increasingly desirable to provide an effective device for holding and feeding large volumes of copy sheets to provide uninterrupted copying jobs. It is further desirable to be able to load additional copy sheets into a machine without having to shut down the machine operation while doing so. It is also desirable to be able to feed variable sized documents from a single feed source thereby minimizing the required footprint of the machine for space saving considerations.

The following disclosures may be relevant to various aspects of the present invention:

| |
|---|
| U.S. Pat. No. 5,096,181 |
| Patentee: Sukumaran et al. |
| Issue Date: March 17, 1992 |
| U.S. Pat. No. 5,085,419 |
| Patentee: Bell |
| Issue Date: February 4, 1992 |
| U.S. Pat. No. 4,640,602 |
| Patentee: Redding et ano. |
| Issue Date: February 3, 1987 |
| U.S. Pat. No. 4,556,210 |
| Patentee: George |
| Issue Date: December 3, 1985 |
| U.S. Pat. No. 4,008,957 |
| Patentee: Summers |
| Issue Date: February 22, 1977 |
| Xerox Disclosure Journal |
| Volume 9, No. 2, Page 113, 114 |
| Inventor: Oagley |

The relevant portions of the foregoing disclosures may be briefly summarized as follows:

U.S. Pat. No. 5,096,181 describes a sheet stack loader and unloader arrangement utilizing a dedicated sheet stack container and a pusher arrangement to transfer a replacement sheet stack to an active feeding station.

U.S. Pat. No. 5,085,419 discloses an insertable tray which is manually inserted into an automatic feed tray to allow the feeding of smaller sized sheets from the feed tray.

U.S. Pat. No. 4,640,602 discloses a sheet feeding apparatus in which a stack of sheets is held in a vertical orientation for feeding to a sheet feeder.

U.S. Pat. No. 4,556,210 describes a sheet supply receptacle which a substantial quantity of paper to be preloaded into said receptacle. When the receptacle is empty, it can be removed manually and a new receptacle already prefilled with paper can be reloaded into the copying machine.

U.S. Pat. No. 4,008,957 describes an electrophotographic reproduction machine having plural feed heads and copy sheet trays and permitting switchover from one tray to another when the first tray is depleted.

Xerox Disclosure Journal, Volume 9, No. 2 discloses a copy handling module having multiple feed heads and multiple trays which allow the loading of one tray while another tray is feeding and provides for automatic switchover from one tray to another by use of a low paper sensor.

In accordance with one aspect of the present invention, there is provided an apparatus for feeding sheets. The apparatus comprises means for advancing sheets and means for supporting a first stack of sheets in an operative position enabling the advancing means to advance sheets therefrom and a second stack of sheets in a non-operative position remote from the advancing means. Means for sensing depletion of the first stack of sheets and emitting a signal indicative thereof and means, responsive to the signal from the sensing means, for transporting the second stack sheets from the non-operative position to the operative position are also provided.

Pursuant to another aspect of the present invention, there is provided an electrophotographic printing machine having a high-capacity sheet feeder. The improvement comprises means for advancing sheets and means for supporting a first stack of sheets in an operative position enabling the advancing means to advance sheets therefrom and a second stack of sheets in a non-operative position remote from the advancing means. Means for sensing depletion of the first stack of sheets and emitting a signal indicative thereof and means, responsive to the signal from the sensing means, for transporting the second stack sheets from the non-operative position to the operative position are also provided.

Other features of the present invention will become apparent as the following description proceeds and upon reference to the drawings, in which.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 9:
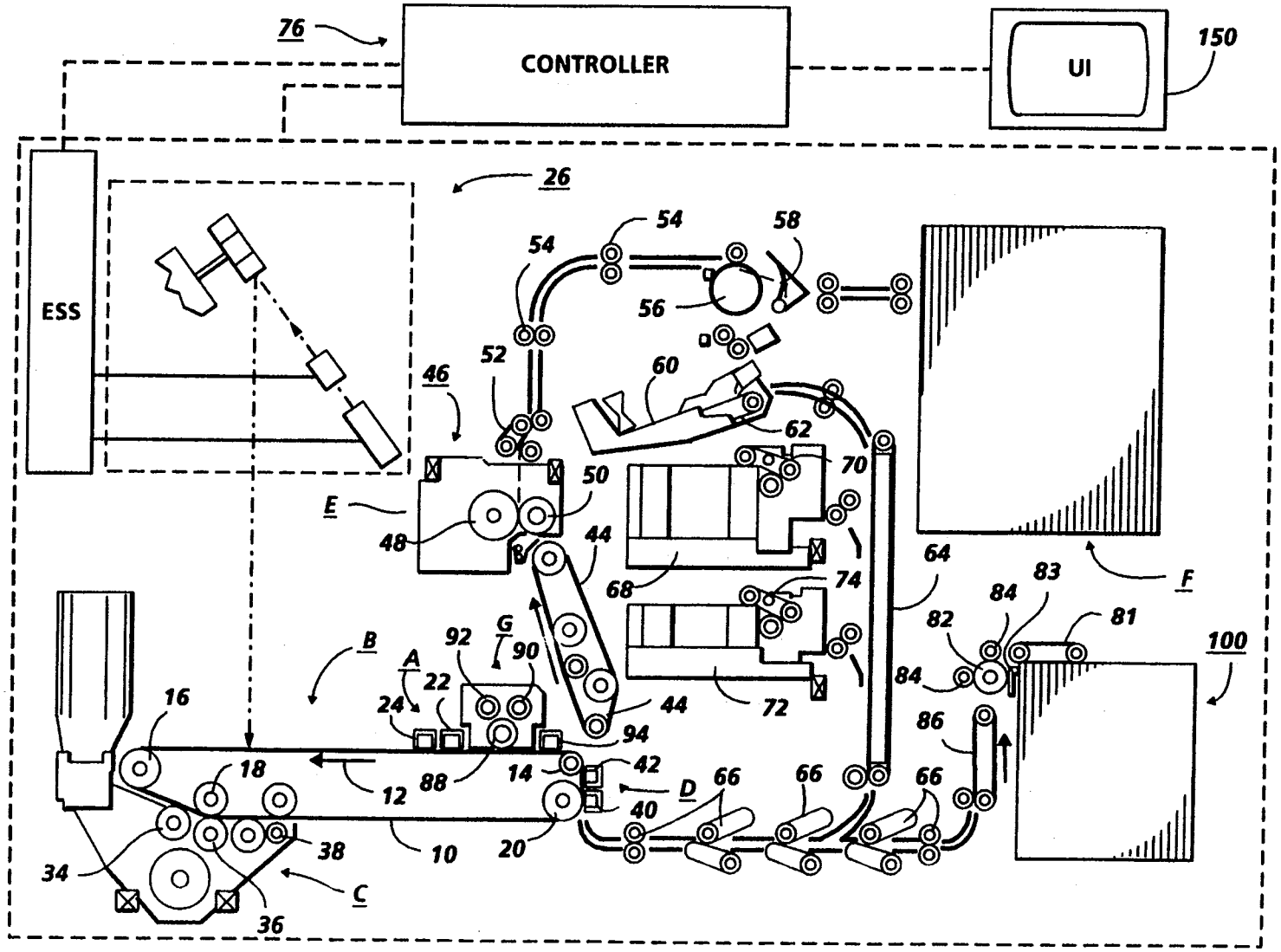
FIG. 9 is a schematic elevational view of an electrophotographic printing machine including the high capacity variable sheet size sheet feeder of the present invention therein.

For a general understanding of the features of the present invention, reference is made to the drawings. In the drawings, like reference numerals have been used throughout to identify identical elements. FIG. 9 schematically depicts an electrophotographic printing machine incorporating the features of the present invention therein. It will become evident from the following discussion that the sheet feeding apparatus of the present invention may be employed in a wide variety of devices and is not specifically limited in its application to the particular embodiment depicted herein.

Referring to FIG. 9 of the drawings, the electrophotographic printing machine employs a photoconductive belt 10. preferably, the photoconductive belt 10 is made from a photoconductive material coated on a ground layer, which, in turn, is coated on an anti-curl backing layer. The photoconductive material is made from a transport layer coated on a selenium generator layer. The transport layer transports positive charges from the generator layer. The generator layer is coated on an interface layer. The interface layer is coated on the ground layer made from a titanium coated Mylar TM. The interface layer aids in the transfer of electrons to the ground layer. The ground layer is very thin and allows light to pass therethrough. Other suitable photoconductive materials, ground layers, and anti-curl backing layers may also be employed. Belt 10 moves in the direction of arrow 12 to advance successive portions sequentially through the various processing stations disposed about the path of movement thereof. Belt 10 is entrained about stripping roller 14, tensioning roller 16, idler roll 18 and drive roller 20. Stripping roller 14 and idler roller 18 are mounted rotatably so as to rotate with belt 10. Tensioning roller 16 is resiliently urged against belt 10 to maintain belt 10 under the desired tension. Drive roller 20 is rotated by a motor coupled thereto by suitable means such as a belt drive. As roller 20 rotates, it advances belt 10 in the direction of arrow 12.

Initially, a portion of the photoconductive surface passes through charging station A. At charging station A, two corona generating devices indicated generally by the reference numerals 22 and 24 charge the photoconductive belt 10 to a relatively high, substantially uniform potential. Corona generating device 22 places all of the required charge on photoconductive belt 10. Corona generating device 24 acts as a leveling device, and fills in any areas missed by corona generating device 22.

Next, the charged portion of the photoconductive surface is advanced through imaging station B. At the imaging station, an imaging module indicated generally by the reference numeral 30, records an electrostatic latent image on the photoconductive surface of the belt 10. Imaging module 30 includes a raster output scanner (ROS). The ROS lays out the electrostatic latent image in a series of horizontal scan lines with each line having a specified number of pixels per inch. Other types of imaging systems may also be used employing, for example, a pivoting or shiftable LED write bar or projection LCD (liquid crystal display) or other electro-optic display as the "write" source.

Here, the imaging module 30 (ROS) includes a laser 110 for generating a collimated beam of monochromatic radiation 120, an electronic subsystem (ESS), located in the machine electronic printing controller 100 that transmits a set of signals via 114 corresponding to a series of pixels to the laser 110 and/or modulator 112, a modulator and beam shaping optics unit 112, which modulates the beam 120 in accordance with the image information received from the ESS, and a rotatable polygon 118 having mirror facets for sweep deflecting the beam 122 into raster scan lines which sequentially expose the surface of the belt 10 at imaging station B.

Thereafter, belt 10 advances the electrostatic latent image recorded thereon to development station C. Development station C has three magnetic brush developer rolls indicated generally by the reference numerals 34, 36 and 38. A paddle wheel picks up developer material and delivers it to the developer rolls. When the developer material reaches rolls 34 and 36, it is magnetically split between the rolls with half of the developer material being delivered to each roll. Photoconductive belt 10 is partially wrapped about rolls 34 and 36 to form extended development zones. Developer roll 38 is a clean-up roll. A magnetic roll, positioned after developer roll 38, in the direction of arrow 12 is a carrier granule removal device adapted to remove any carrier granules adhering to belt 10. Thus, rolls 34 and 36 advance developer material into contact with the electrostatic latent image. The latent image attracts toner particles from the carrier granules of the developer material to form a toner powder image on the photoconductive surface of belt 10. Belt 10 then advances the toner powder image to transfer station D.

At transfer station D, a copy sheet is moved into contact with the toner powder image. First, photoconductive belt 10 is exposed to a pretransfer light from a lamp (not shown) to reduce the attraction between photoconductive belt 10 and the toner powder image. Next, a corona generating device 40 charges the copy sheet to the proper magnitude and polarity so that the copy sheet is tacked to photoconductive belt 10 and the toner powder image attracted from the photoconductive belt to the copy sheet. After transfer, corona generator 42 charges the copy sheet to the opposite polarity to detack the copy sheet from belt 10. Conveyor 44 advances the copy sheet to fusing station E.

Fusing station E includes a fuser assembly indicated generally by the reference numeral 46 which permanently affixes the transferred toner powder image to the copy sheet. Preferably, fuser assembly 46 includes a heated fuser roller 48 and a pressure roller 50 with the powder image on the copy sheet contacting fuser roller 48. The pressure roller is cammed against the fuser roller to provide the necessary pressure to fix the toner powder image to the copy sheet. The fuser roll is internally heated by a quartz lamp. Release agent, stored in a reservoir, is pumped to a metering roll. A trim blade trims off the excess release agent. The release agent transfers to a donor roll and then to the fuser roll.

After fusing, the copy sheets are fed through a decurler 52. Decurler 52 bends the copy sheet in one direction to put a known curl in the copy sheet and then bends it in the opposite direction to remove that curl.

Forwarding rollers 54 then advance the sheet to duplex turn roll 56. Duplex solenoid gate 58 guides the sheet to the finishing station F, or to duplex tray 60. At finishing station F, copy sheets are stacked in a compiler tray and attached to one another to form sets. The sheets are attached to one another by either a binder or a stapler. In either case, a plurality of sets of documents are formed in finishing station F. When duplex solenoid gate 58 diverts the sheet into duplex tray 60. Duplex tray 60 provides an intermediate or buffer storage for those sheets that have been printed on one side and on which an image will be subsequently printed on the second, opposite side thereof, i.e., the sheets being duplexed. The sheets are stacked in duplex tray 60 face-down on top of one another in the order in which they are copied.

In order to complete duplex copying, the simplex sheets in tray 60 are fed, in seriatim, by bottom feeder 62 from tray 60 back to transfer station D via conveyor 64 and rollers 66 for transfer of the toner powder image to the opposed sides of the copy sheets. Inasmuch as successive bottom sheets are fed from duplex tray 60, the proper or clean side of the copy sheet is positioned in contact with belt 10 at transfer station D so that the toner powder image is transferred thereto. The duplex sheet is then fed through the same path as the simplex sheet to be advanced to finishing station F.

Copy sheets are fed to transfer station D from the secondary tray 68. The secondary tray 68 includes an elevator driven by a bidirectional AC motor. Its controller has the ability to drive the tray up or down. When the tray is in the down position, stacks of copy sheets are loaded thereon or unloaded therefrom. In the up position, successive copy sheets may be fed therefrom by sheet feeder 70. Sheet feeder 70 is a friction retard feeder utilizing a feed belt and take-away rolls to advance successive copy sheets to transport 64 which advances the sheets to rolls 66 and then to transfer station D.

Copy sheets may also be fed to transfer station D from the auxiliary tray 72. The auxiliary tray 72 includes an elevator driven by a directional AC motor. Its controller has the ability to drive the tray up or down. When the tray is in the down position, stacks of copy sheets are loaded thereon or unloaded therefrom. In the up position, successive copy sheets may be fed therefrom by sheet feeder 74. Sheet feeder 74 is a friction retard feeder utilizing a feed belt and take-away rolls to advance successive copy sheets to transport 64 which advances the sheets to rolls 66 and then to transfer station D.

Secondary tray 68 and auxiliary tray 72 are secondary sources of copy sheets. The high capacity variable sheet size sheet feeder of the present invention, indicated generally by the reference numeral 100, is the primary source of copy sheets. Feed belt 81 feeds successive uppermost sheets from the stack to a take-away drive roll 82 and idler rolls 84. The drive roll and idler rolls guide the sheet onto transport 86. Transport 86 advances the sheet to rolls 66 which, in turn, move the sheet to transfer station D. Further details of the operation of high capacity variable sheet size sheet feeder 100 will be described hereinafter with reference to FIGS. 1–8.

Invariably, after the copy sheet is separated from the photoconductive belt 10, some residual particles remain adhering thereto. After transfer, photoconductive belt 10 passes beneath corona generating device 94 which charges the residual toner particles to the proper polarity. Thereafter, the pre-charge erase lamp (not shown), located inside photoconductive belt 10, discharges the photoconductive belt in preparation for the next charging cycle. Residual particles are removed from the photoconductive surface at cleaning station G. Cleaning station G includes an electrically biased cleaner brush 88 and two de-toning rolls. The reclaim roll is electrically biased negatively relative to the cleaner roll so as to remove toner particles therefrom. The waste roll is electrically biased positively relative to the reclaim roll so as to remove paper debris and wrong sign toner particles. The toner particles on the reclaim roll are scraped off and deposited in a reclaim auger (not shown), where it is transported out of the rear of cleaning station G.

The various machine functions are regulated by a controller 76. The controller 76 is preferably a programmable microprocessor which controls all of the machine functions hereinbefore described. The controller provides a comparison count of the copy sheets, the number of documents being recirculated, the number of copy sheets selected by the operator, time delays, jam corrections, etc. The control of all of the exemplary systems heretofore described may be accomplished by conventional control switch inputs from the printing machine consoles selected by the operator. Conventional sheet path sensors or switches may be utilized to keep track of the position of the document and the copy sheets. In addition, the controller regulates the various positions of the gates depending upon the mode of operation selected. Thus, when the operator selects the finishing mode, either an adhesive binding apparatus and/or a stapling apparatus will be energized and the gates will be oriented so as to advance either the simplex or duplex copy sheets to finishing station F. The detailed operation of high capacity variable sized sheet sheet feeder 100 will be described hereinafter with reference to FIGS. 1–8.

Figure 1A:
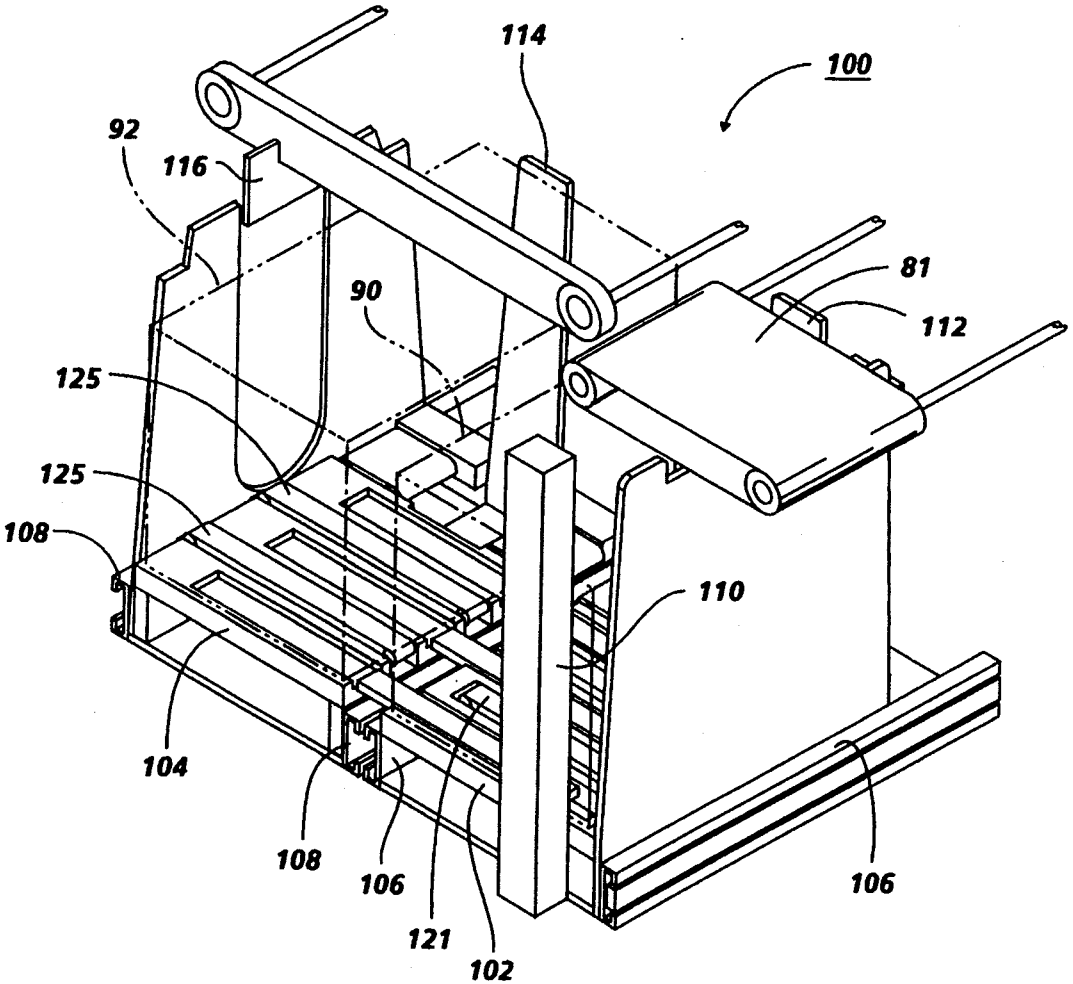
FIG. 1A is a perspective view of the sheet feeder of the present invention in the dual tray load mode of operation.
Figure 1B:
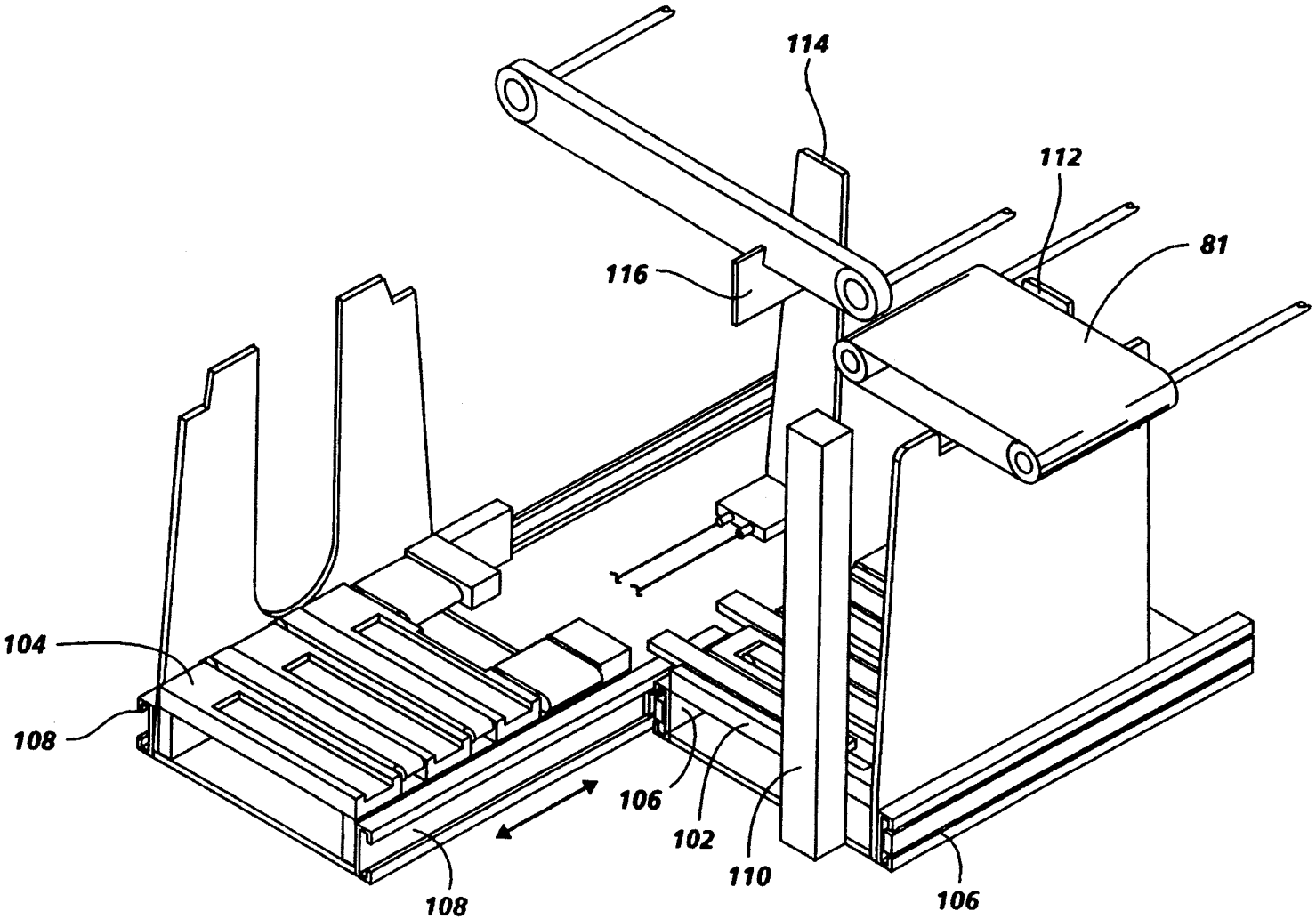
FIG. 1B is a fragmentary perspective view of the sheet feeder of the present invention in the dual tray load while run mode of operation.
Figure 1C:
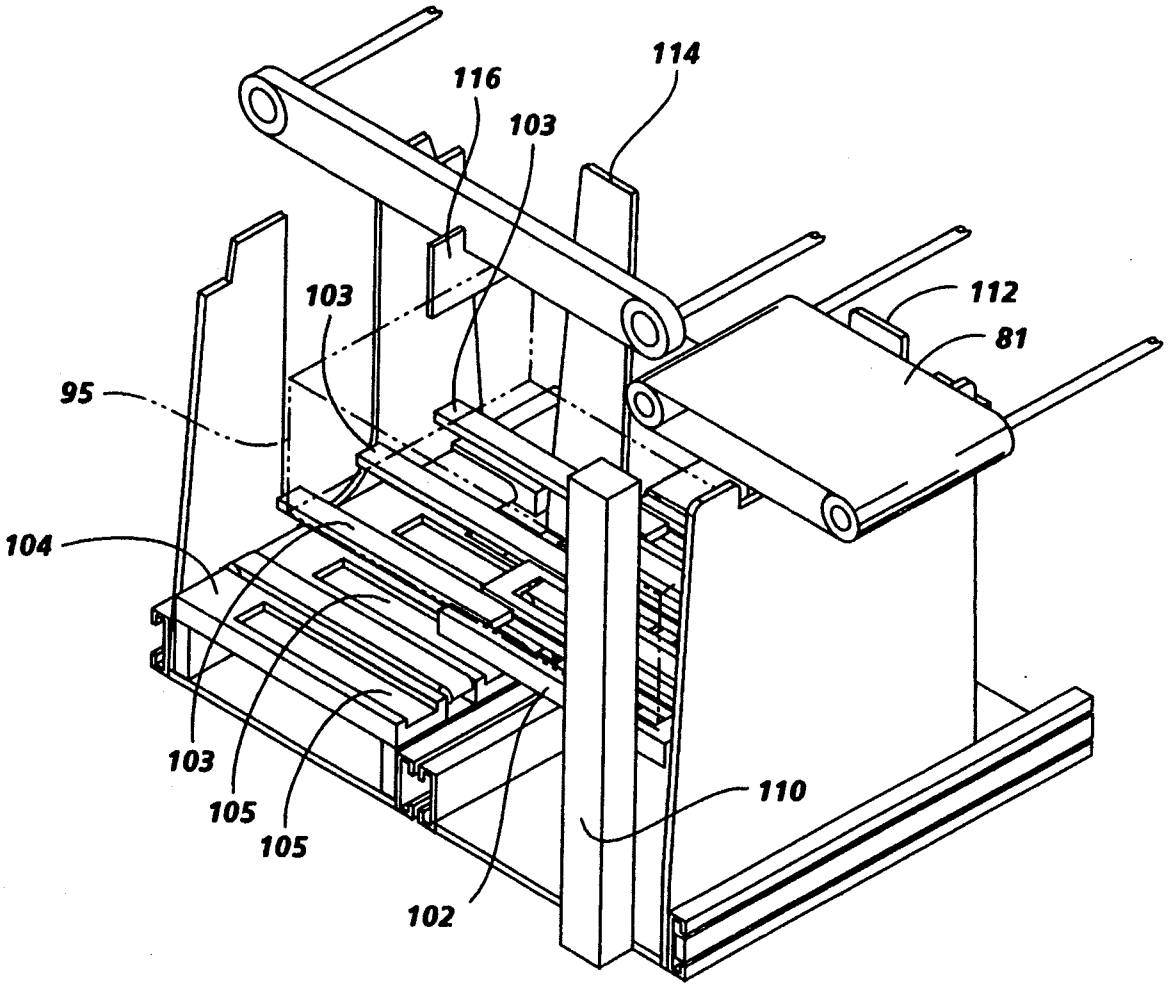
FIG. 1C is a perspective view of the sheet feeder of the present invention in the large sheet format single tray mode of operation.

Turning now to FIGS. 1A, 1B and 1C, the general operation and features of the variable sheet size sheet feeder will be described. Referring initially to FIG. 1A, the sheet feeder assembly 100 has an elevating sheet tray 102 which is a cable-type elevator utilizing cable guide 110. A second sheet stack holding tray 104 is located adjacent to the elevating tray 102. Initially, a stack of sheets 90 is loaded onto tray 102 and a second stack of sheets 92 is loaded onto tray 104. In this mode, either $8\frac{1}{2}'' \times 11''$ or $8\frac{1}{2}'' \times 14''$ sheets may be loaded in this dual tray mode. Either of the above sized sheets will be fed to the printing machine long edge first. Tray 102 is able to be slid on tray guides 106 for ease of loading. Tray 104 also is slideable on tray guides 108, also for ease of loading.

In operation, sheets from the first stack 90 loaded onto the elevating tray 102, are fed to the machine processor by sheet feeder 81. A traveling rear edge guide and stack height sensor (TREG) 116 (see FIG. 2) monitors the amount of paper on the elevating tray 102. When the initial stack 90 is depleted, the TREG 116 sends a signal to the machine controller 76 (FIG. 10) which causes the elevating tray 102 to return to the lowest point which is the load position. The second stack 92 is then transported from tray 104 to tray 102 by means of drive belts 125 located in the bottom of tray 104 and drive belts 121 located in the bottom of the elevating tray 102. When the stack 92 has been shifted and sensed by TREG 116, which includes a stack location sensor 160 (FIGS. 7A and 7B) which contacts the trailing edge of the stack, to be in the proper location on tray 102, the machine controller then causes the elevating tray 102 to raise and the sheets to be brought in contact with sheet feeder 81. As can then be seen in FIG. 1B, the holding tray 104 can then be slid open and reloaded while the elevating tray 102 continues to feed the second stack 92 to the sheet feeder 81.

For larger format sheet sizes, such as 11"×17" sheets, it can be seen in FIG. 1C that tray 102 has extension arms 103 (shown in further detail in FIG. 4) which enable loading of the large format sheets. When the tray extensions 103 are extended and large format sheet stack 93 loaded, the elevating tray 102 feeds the large format sheets to sheet feeder 81 in the same manner previously described. For large format sheets, however, there is no provision to reload while running as there is no holding tray available. Large format sheets are fed to the printing machine short edge first. The TREG 116 functions in the same manner with the large format sheets to assure proper location of the stack and to monitor the amount of paper in the elevating tray 102 and to send a signal to the controller 76 for display on the user interface 150 when the stack has been depleted.

Figure 2A:
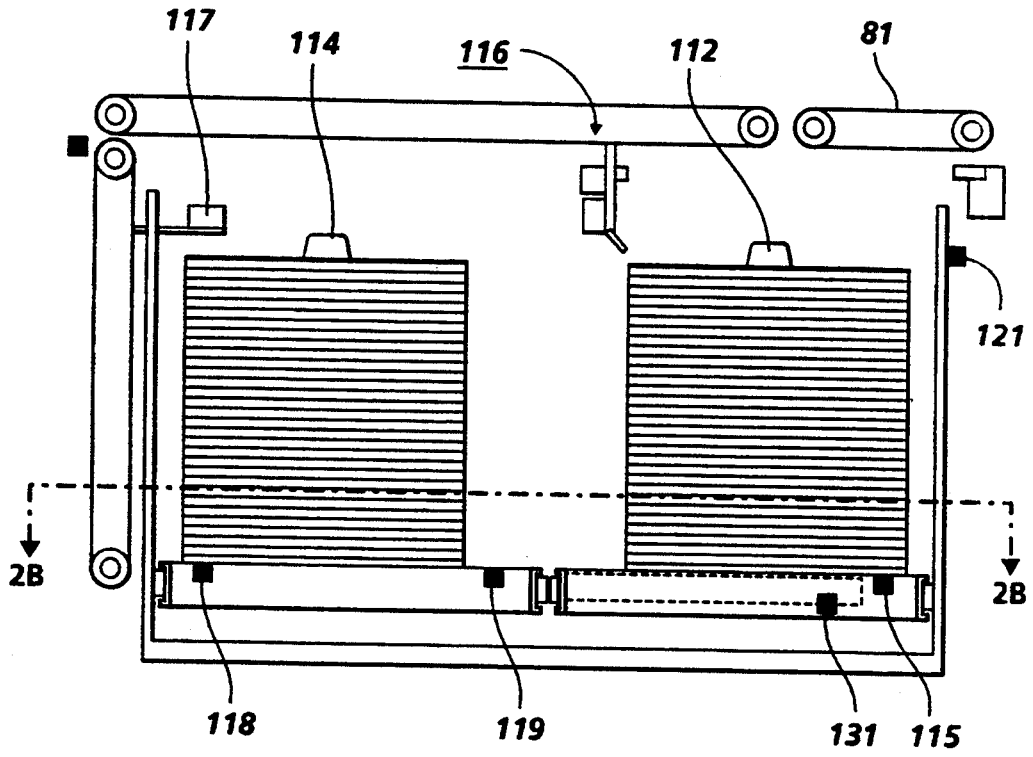
FIG. 2A is a schematic elevational view of the sheet feeder of the present invention illustrating the location of the various sensors.
Figure 2B:
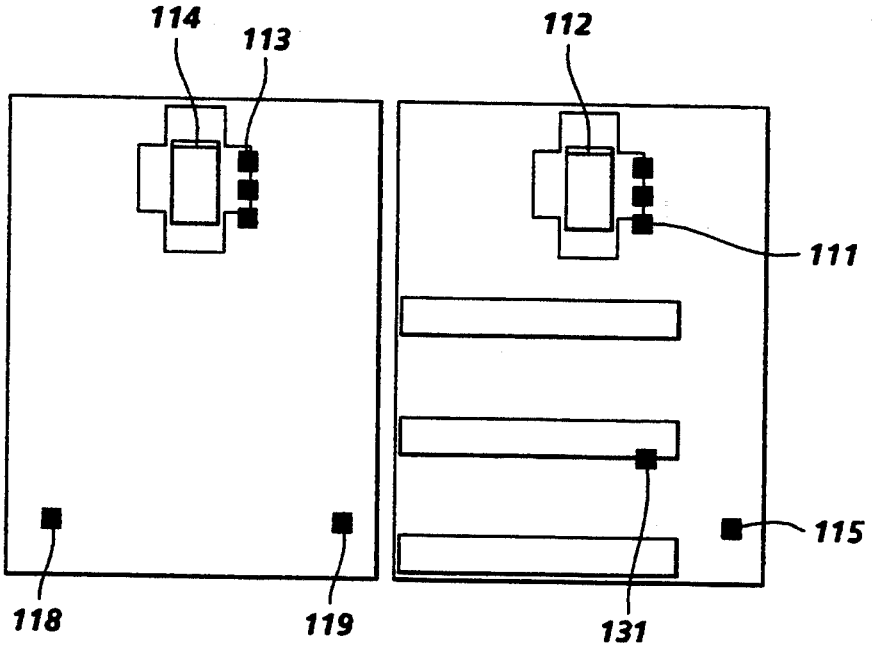
FIG. 2B is a sectional plan view taken along the line in the direction of arrows 2B—2B of FIG. 2A.

Turning now to FIG. 2, the location of the various sensors which determine the operating mode and report the status of the stack heights in the multiple trays to the controller 76 for display on the user interface 150 are illustrated. Referring first to FIG. 2A, there can be seen the front tray registration sensor 115 which determines when there is paper in the elevating tray 102. TREG 116 is used to determine the position of the stack 92 and further determines when the stack 92 located in the elevating tray 102 is depleted. There is also a stack height switch 117 for the holding tray 104. A large format sheet sensor 119 located in the bottom of tray 104 recognizes when larger than standard size sheets are being used. Additionally, a front tray extension sensor 131 monitors the position of the tray extension 103 in tray 102. Side guides 112 and 114 are provided to maintain integrity of the stacks while they are in trays 102 and 104. However, when a stack is shifted from tray 104 to the elevating tray 102, the side guides must be moved out of the way so as to not interfere with the transport of the stacks. Side guides switches 111 and 113 (FIG. 2B) are provided to monitor the position of the side guides and to assure that the guides are retracted during transport of the stack from the holding tray 104 to the elevating tray 102 and then returned to the proper position once the stack transport has been completed.

Figure 3:
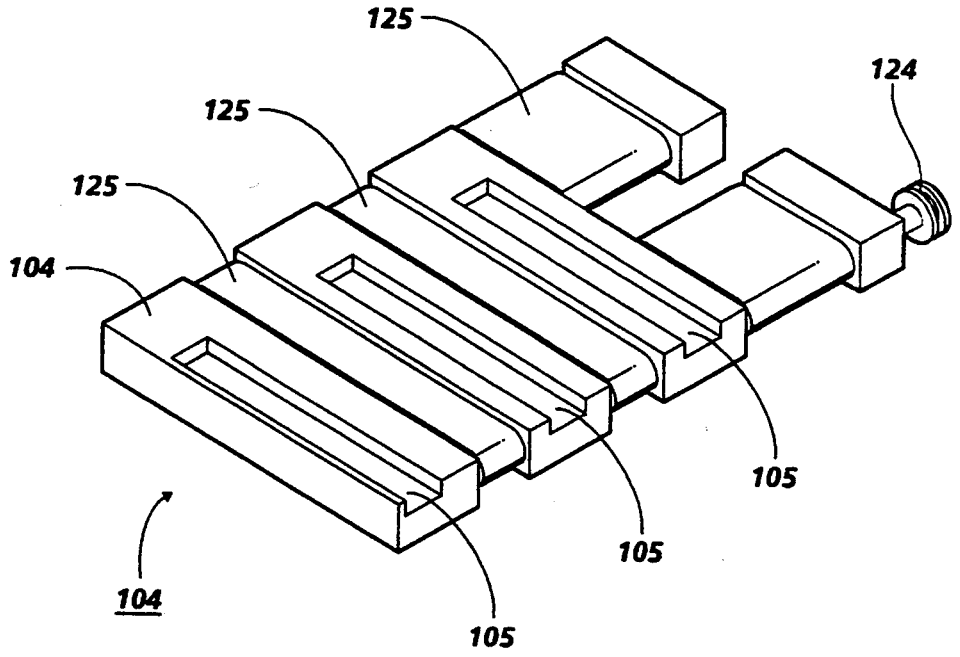
FIG. 3 is a perspective view of the holding tray of the sheet feeder.
Figure 4:
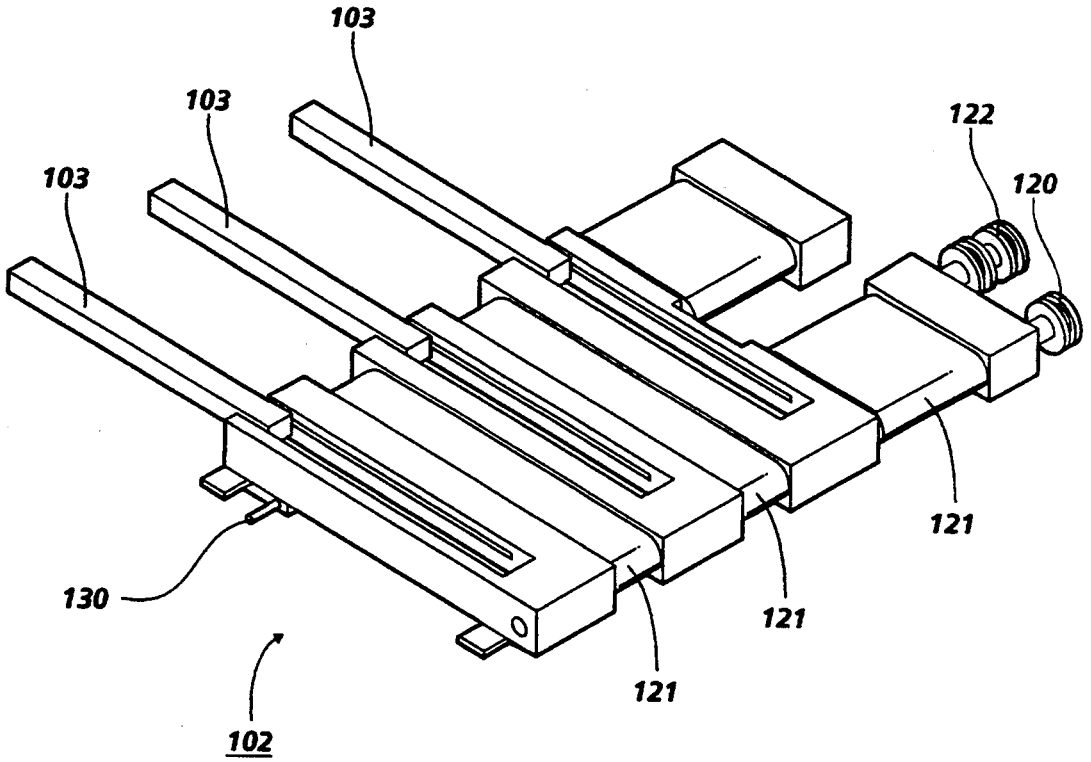
FIG. 4 is a perspective view of the elevating tray of the sheet feeder.

Details of the trays are illustrated in FIGS. 3 and 4. FIG. 3 illustrates the holding tray 104, which has transport belts 125 which are driven by drive pulley 124. There are slots 105 in the holding tray so that when large format sheets are utilized, the tray extensions 103 of tray 102 can be extended and will not interfere with the bottom of the stack. Turning to FIG. 4, elevating tray 102 also has drive belts 121 which are driven by drive pulley 120. Intermediate drive 122 acts as a connection between the main drive and the holding tray to actuate drive pulley 124 of the holding tray 104 when both trays are in the lower position and ready for transport. Tray extensions 103 are also provided with a guide pin 130 which is utilized in conjunction with a movable pin guide 132 connected to an exterior handle 138 for operator use (see FIG. 5).

Figure 5:
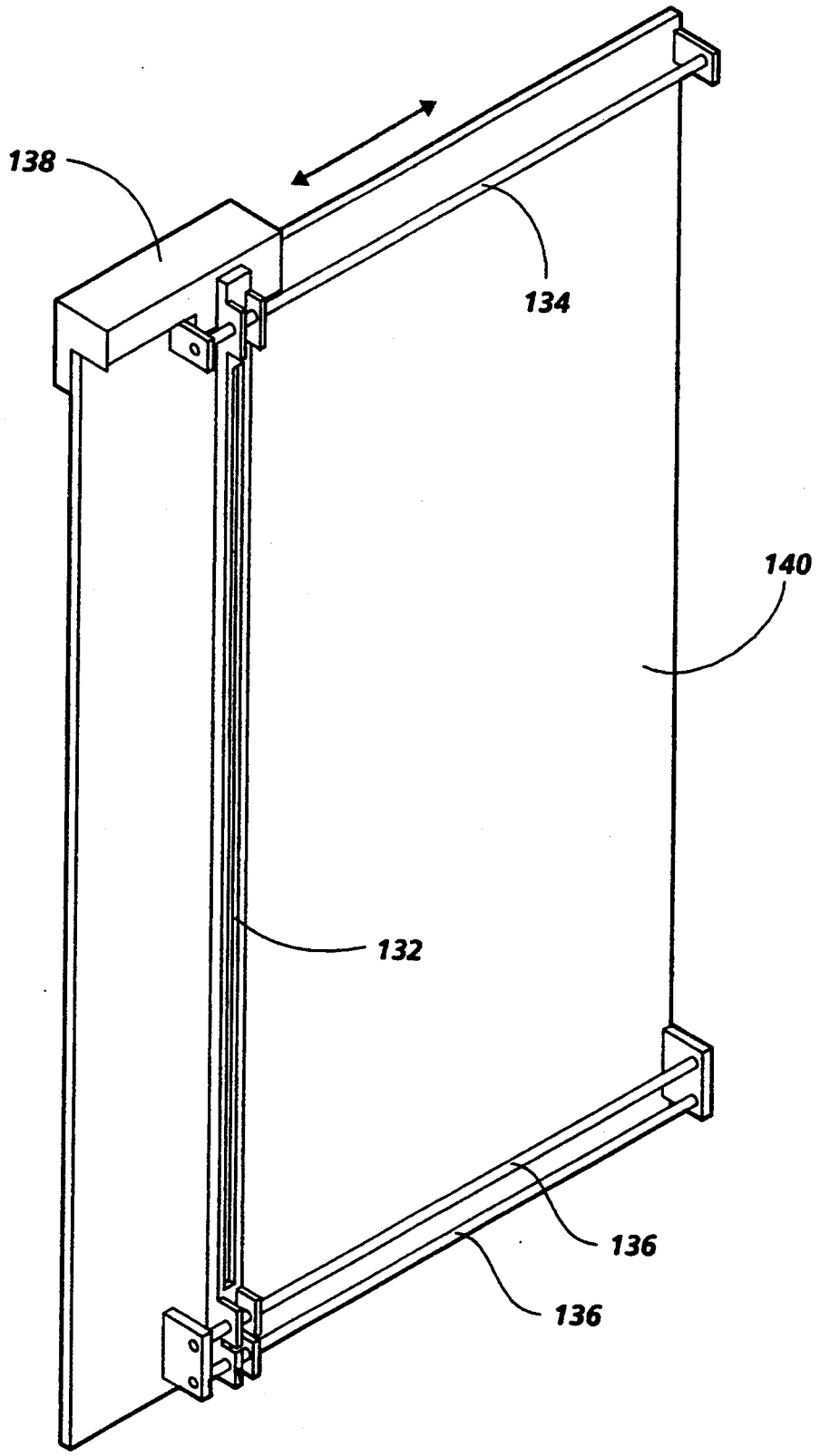
FIG. 5 is a perspective view of the cover of the sheet feeder.

Turning now to FIG. 5, the interior of the front cover 140 of the sheet feeder is illustrated. The cover is provided with a handle 138, which is connected to pin guide channel 132. The guide channel 132 is laterally moveable along rails 134 and 136. When using large format sheets, the handle is slid to the outboard position and as a result of the extension pin 130 being within the pin guide 132, the tray extensions 103 of tray 102 are extended to receive large format sheets. The cover 140 is then opened and the large format sheets loaded. The exterior handle 138 provides a visual cue to an operator that large format sheets are being fed. This is in addition to the signal transmitted by the large format sensor 119 which is then displayed on the user interface 150 (FIG. 8) to indicate that large format documents are loaded on the elevating tray 102.

Figure 6:
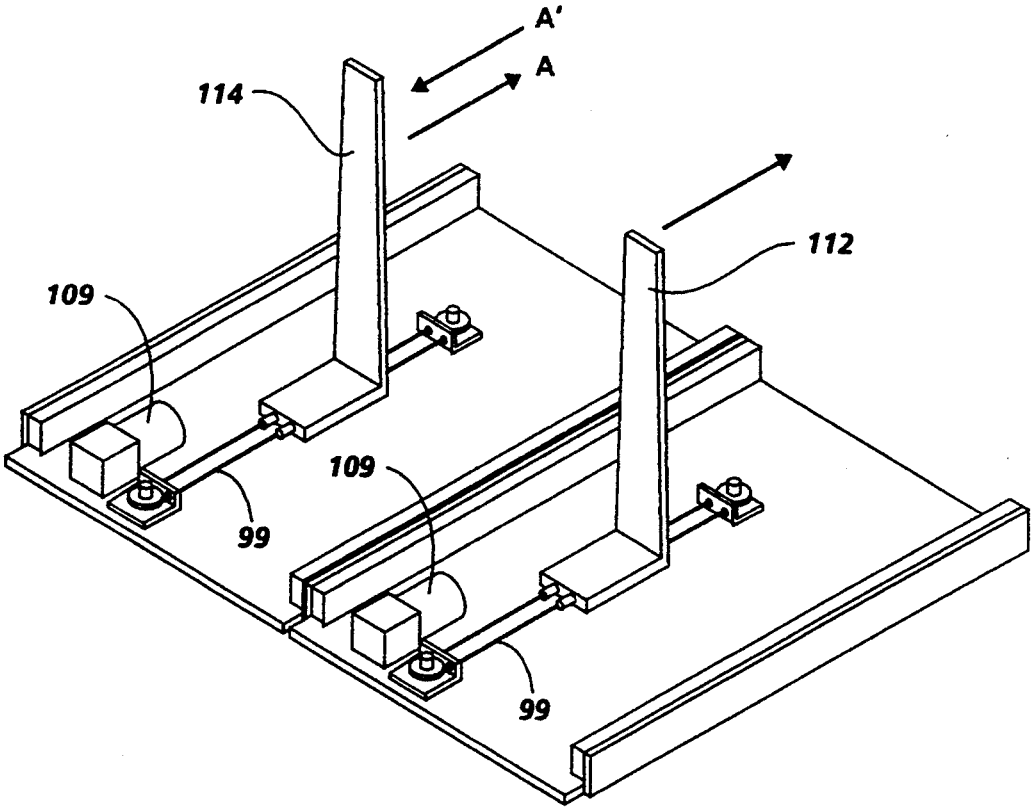
FIG. 6 is a plan view of the side guide drive system of the sheet feeder.

FIG. 6 illustrates the drive assembly 109 for the tray side guards 112 and 114. The side guards 112 and 114 are driven by a cable drive system 99 powered by motors 109 controlled by the machine controller 76. As previously described, the side guides 112, 114 are retracted in the direction of arrow A when the stacks are transported from one tray to another. Once the stack is transported and in the proper location on elevating tray 102, the side guides are then moved in the direction of arrow A' to support the stack.

The present concept allows the operator to access the paper trays in several manners. In the dual tray mode (DTM), the operator can access the holding tray in a load-while-run mode or access both trays to reload both trays to change paper size, etc.. In the single tray mode (STM), the trays are coupled together to act as a single tray. In STM, the operator has access to both trays but cannot access the trays while elevating tray 102 is actively feeding sheets.

Figure 7A:
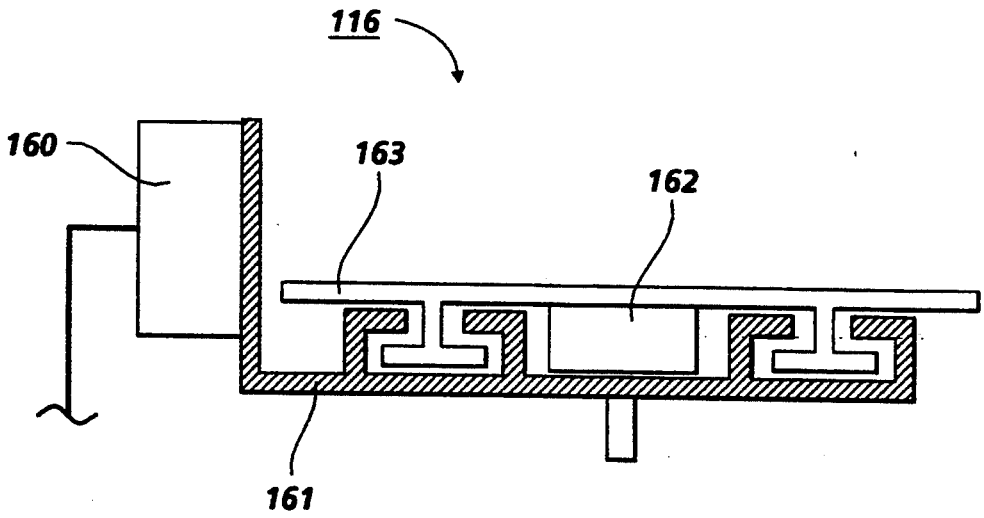
FIGS. 7A and 7B are elevational views partially in section of the traveling rear edge guide sensor used in the sheet feeder.
Figure 7B:
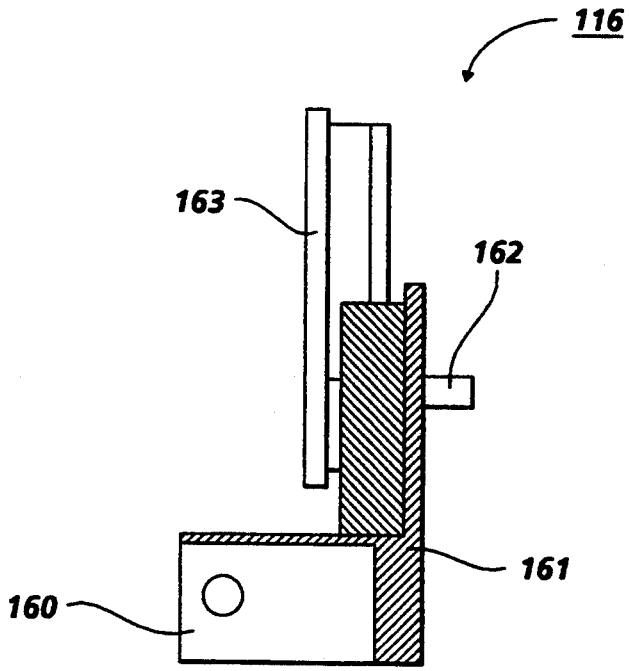

When the dual tray feeder has been loaded the current status, be it STM or DTM, is determined by the input from the various sensors. After this is completed, the elevating tray 102 is raised until the stack activates the seek position sensor 121 (see FIG. 2). This seek position sensor 121 causes the TREG 116 to be activated and to travel until the rear edge of the stack in tray 102 is located. A detail of the TREG is illustrated in FIGS. 7A and 7B. The TREG 116 is made up of a stack location switch 160 which is support on a bracket 161 which is slideably connected to a second bracket 163 which supports the stack height switch 162. The TREG 116 is constructed so that it will travel over any paper stack in the holding tray 104 even if the holding tray 104 is filled to capacity. Once the stack locating switch 160 of the TREG 116 is actuated, the elevating tray 102 can be raised until the stack height switch 162 of the TREG 116 is actuated by the top of the stack. Feeding can begin immediately thereafter. When the stack is depleted, a signal is sent to the controller 76 by the TREG 116, the elevating tray 102 then lowers and the second stack is transported from the holding tray 104 to the elevating tray 102. The above stack feed procedure is repeated and the holding tray 104 is then available for reloading by the operator.

The design herein also provides several options for the operator with regard to the tray mode status. The available options are summarized in the following chart:

| Current Mode | Desired Mode | Availability of Trays |
|---|---|---|
| STM | STM | Both Trays Available<br>No Active Feeding |
| STM | DTM | Both Trays Available<br>No Active Feeding |
| DTM | STM | Both Trays Available<br>No Active Feeding |
| DTM | DTM<br>(Change both stacks) | Both Trays Available<br>No Active Feeding |
| DTM | DTM<br>(Run-While-Load) | Holding Tray Available<br>Elevating Tray Feeding |

Figure 8:
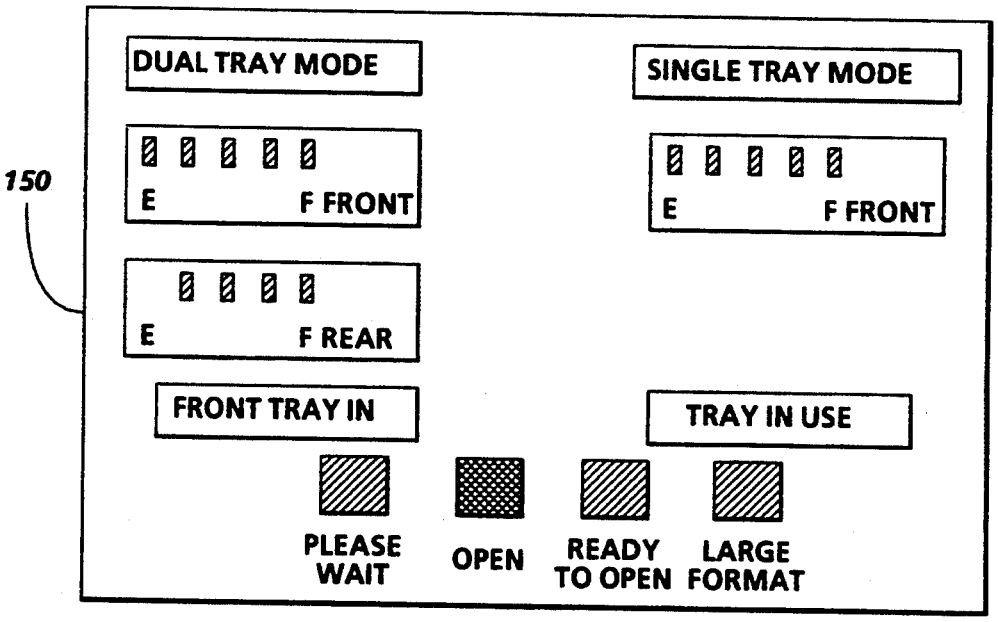
FIG. 8 is an elevational view of the user interface used in the FIG. 9 printing machine.

An exemplary detail of a user interface 150 used to indicate the mode and options is illustrated in FIG. 8. The user interface 150 provides indicators for the paper quantity in the trays in either dual or single tray mode. The feed status of the elevating tray and the availability of the loading tray are also indicated. As previously noted, there is also an indicator to alert an operator that large format documents are loaded on the elevating tray 102 thus signaling single tray mode only.

In recapitulation, there is provided a variable sheet size sheet feeder having a dual tray adapted to be reloaded while running in a dual tray mode. Sheets being fed from the stack are held in an elevating tray and a stack for replenishing the elevating tray is held in a holding tray. When the elevating tray is empty, the tray lowers to the lowest point at which the stack from the holding tray is automatically transported to the elevating tray. The elevating tray then feeds the sheet feeder and the holding tray is available for reloading by an operator. Large format sheets are also able to be handled by the elevating tray by extensions provided in said tray which are extended to support over-sized sheets. There is a operator user interface which is provided to display the current operating mode and the available modes in which the feeder may function and to report the load status of each tray.

It is, therefore, apparent that there has been provided in accordance with the present invention, a high capacity variable sheet size sheet feeder that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

We claim:

1. An apparatus for feeding sheets, comprising:

means for advancing sheets;

means for supporting a first stack of sheets in an operative position enabling said advancing means to advance sheets therefrom and a second stack of sheets in a non-operative position remote from said advancing means in a first operating replenishment mode and supporting only a third stack of sheets in a second nonreplenishment operating mode, said supporting means comprising a first tray for supporting the first and third stacks of sheets therein and a second tray for supporting the second stack of sheets therein;

means for sensing depletion of the first stack of sheets and emitting a signal indicative thereof;

means, responsive to the signal from said sensing means, for transporting the second stack sheets from said second tray to said first tray to replenish said first tray in said first operating mode; and means for converting said supporting means from supporting the first stack in the operative position and the second stack in the non-operative position in the first operating mode to supporting only the third stack of sheets with the third stack being of a size to overlap said second tray in the second operating mode, wherein only said first tray supports said third stack in the second operating mode.

2. An apparatus according to claim 1, wherein said transporting means comprises means for moving the first tray between a loading position, wherein the second stack of sheets is loaded thereon, and the operative position.

3. An apparatus according to claim 2, wherein said transporting means comprises:

a first set of moving belts associated with said first tray; and a second set of moving belts associated with said second tray, said first set of belts cooperating with said second set of belts to move the second stack of sheets from the second tray to the first tray, in response to the first tray being in the loading position.

4. An apparatus according to claim 1, wherein the sheets of the first stack and the sheets of the second stack are of equal area.

5. An apparatus according to claim 1, wherein the sheets of the first stack and the sheets of the third stack are unequal area.

6. An apparatus according to claim 1, wherein said sensing means detects that the first sheet stack is in the operative position.

7. An electrophotographic printing machine having a high-capacity sheet feeder capable of feeding variable-sized sheets from the feeder comprising:

means for advancing sheets;

means for supporting a first stack of sheets in an operative position enabling said advancing means to advance sheets therefrom and a second stack of sheets in a non-operative position remote from said advancing means in a first operating replenishment mode and supporting only a third stack of sheets in a second nonreplenishment operating mode, said supporting means comprising a first tray for supporting the first and third stacks of sheets therein and a second tray for supporting the second stack of sheets therein;

means for sensing depletion of the first stack of sheets and emitting a signal indicative thereof;

means, responsive to the signal from said sensing means, for transporting the second stack sheets from said second tray to said first tray to replenish said first tray in said first operating mode; and means for converting said supporting means from supporting the first stack in the operative position and the second stack in the non-operative position in the first operating mode to supporting only the third stack of sheets with the third stack being of a size to overlap said second tray in the second operating mode, wherein only said first tray supports said third stack in the second operating mode.

8. A printing machine according to claim 7, wherein said transporting means comprises means for moving the first tray between a loading position, wherein the second stack of sheets is loaded thereon, and the operative position.

9. A printing machine according to claim 8, wherein said transporting means comprises:

a first set of moving belts associated with said first tray; and a second set of moving belts associated with said second tray, said first set of belts cooperating with said second set of belts to move the second stack of sheets from the second tray to the first tray, in response to the first tray being in the loading position.

10. A printing machine according to claim 7, wherein the sheets of the first stack and the sheets of the second stack are of equal area.

11. A printing machine according to claim 7, wherein the sheets of the first stack and the sheets of third stack are unequal area.

12. A printing machine according to claim 7, wherein said sensing means detects that the first sheet stack is in the operative position.

* * * * *